United States Patent [19]

Bennett

[11] Patent Number: 4,869,009

[45] Date of Patent: Sep. 26, 1989

[54] DOUBLE BARREL SHOTGUN RELOADER

[76] Inventor: Steven E. Bennett, 231 SW. Broadmoor, Topeka, Kans. 66606

[21] Appl. No.: 233,470

[22] Filed: Aug. 18, 1988

[51] Int. Cl.[4] ..... F41C 27/00; F42B 39/06

[52] U.S. Cl. ..... 42/87

[58] Field of Search ..... 42/87, 88, 89

[56] References Cited

U.S. PATENT DOCUMENTS

| | | | |
|---|---|---|---|
| 710,324 | 9/1902 | Hylard | 224/203 |
| 863,798 | 8/1907 | Hodges | 42/87 |
| 2,592,415 | 4/1952 | Grogan | 42/89 |
| 3,824,729 | 7/1974 | Kubik | 42/89 |
| 4,110,927 | 9/1978 | Morris | 42/98 |
| 4,381,845 | 5/1983 | Feis | 224/196 |
| 4,583,659 | 4/1986 | Carter | 224/239 |
| 4,657,132 | 4/1987 | Abdo | 224/203 |
| 4,679,343 | 7/1987 | Harlow | 42/87 |
| 4,685,600 | 8/1987 | Reuschel | 224/203 |

FOREIGN PATENT DOCUMENTS

| | | | |
|---|---|---|---|
| 2440535 | 7/1980 | France | 42/87 |
| 251576 | 1/1927 | Italy | 42/88 |
| 4884 | of 1903 | United Kingdom | 42/87 |
| 8674 | of 1903 | United Kingdom | 42/88 |
| 18637 | of 1907 | United Kingdom | 42/87 |

*Primary Examiner*—Charles T. Jordan

*Attorney, Agent, or Firm*—Hovey, Williams, Timmons & Collins

[57] ABSTRACT

A device for reloading a shotgun includes a support secured by a strap to the back of the user's hand, and the support along with an internal spring clip releasably holds a shotgun shell in an outwardly extending orientation with the flat, base end of the shell in abutting contact with a flat wall segment of the support. Once the nose of the shell is inserted into the shotgun barrel, the hand is tilted slightly to rock the support relative to the barrel and thereby release a rim of the shell from the spring clip so that the hand can be pulled away from the shotgun with the shell in place in the barrel. In preferred embodiments, the device includes structure for releasably holding two shotgun shells in parallel, side-by-side orientation, and the distance between the longitudinal axes of the shells is equal to the distance between the central axes of the barrels so that the shells may be simultaneously inserted into both barrels and immediately thereafter released at the same time from the device.

6 Claims, 1 Drawing Sheet

Fig. 1.
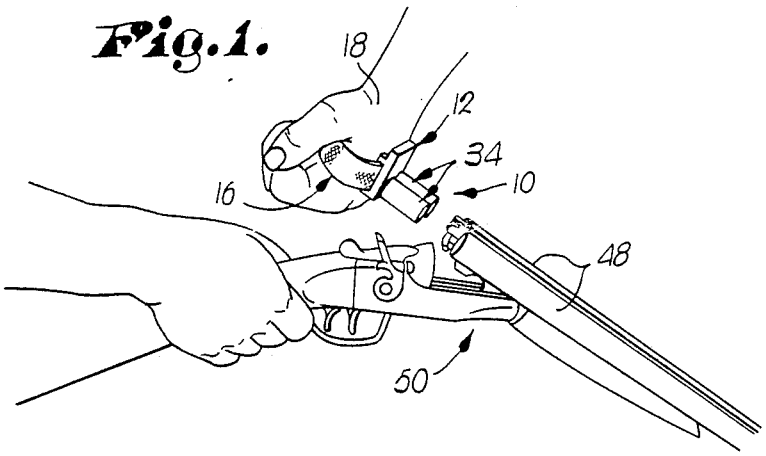
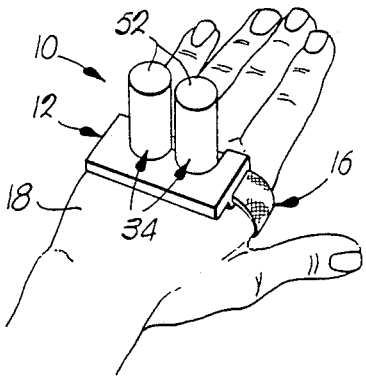
Fig. 2.
Fig. 3.
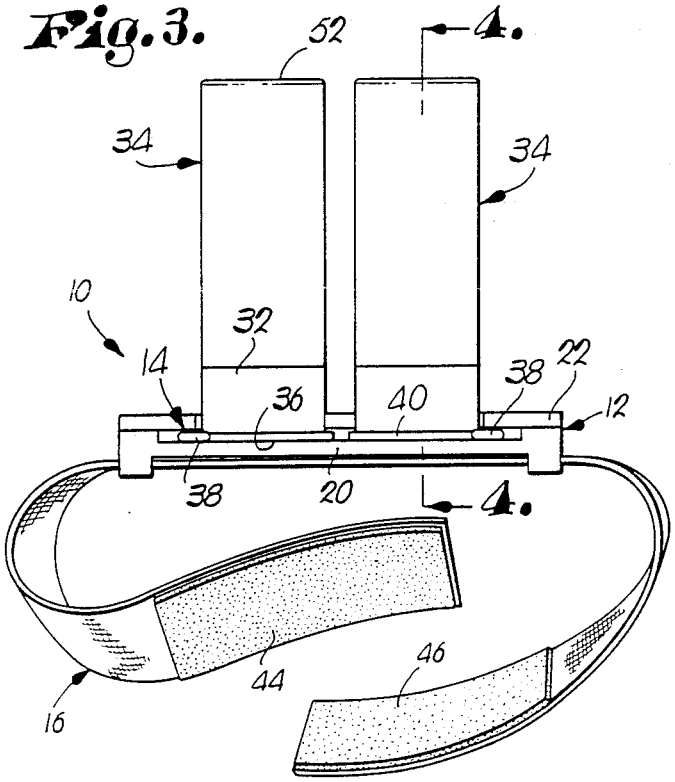
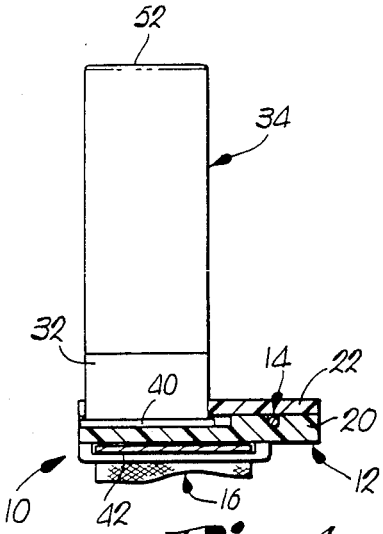
Fig. 4.
Fig. 5.
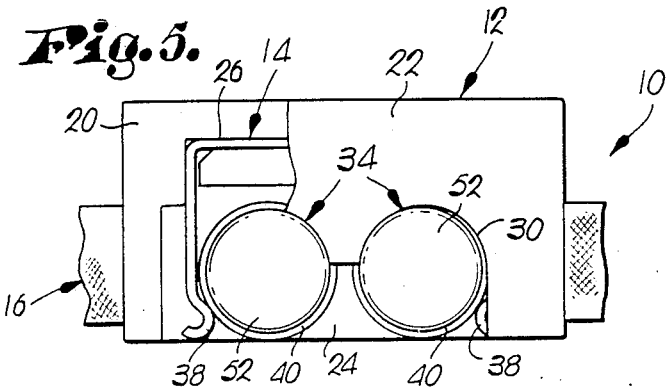
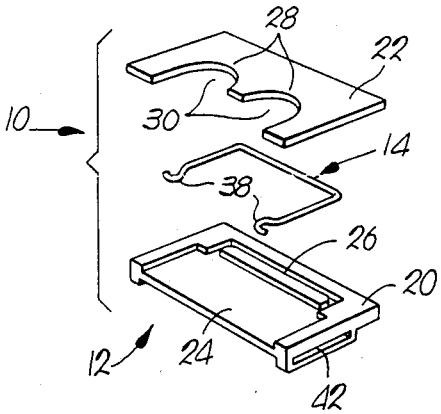
Fig. 6.

DOUBLE BARREL SHOTGUN RELOADER

BACKGROUND OF THE INVENTION

1. Field of the Invention

This invention broadly relates to a device for loading shells into barrels of a shotgun, and specifically concerns a reloading device worn on the back of the hand and adapted to release the shells into the barrels as the device is rocked relative to the shotgun.

2. Description of the Prior Art

Hunters using single barrel and double barrel shotguns are often faced with the problem of rapidly reloading the gun after initial shots are fired. Oftentimes, a number of shells are carried in the pockets of the hunter's clothing or in a pouch worn over the clothing, and to reload the gun the user must reach into the pouch or pocket to grasp a shell, visually observe the shell to determine the nose or forward end of the same, and then place the shell within the barrel by grasping appropriate portions of the base of the shell in order to guide the nose of the shell into the barrel.

As can be appreciated, a substantial amount of time may be lost at inopportune moments while fumbling with loose shells and adjusting the grip in order to insert the nose end of the shell into the barrel. Consequently, the likelihood of a successful hunting trip may be substantially diminished. Moreover, such problems are compounded during cold weather when it is necessary to wear gloves or mittens on the hands.

In the past, others have attempted to solve the foregoing problems by provision of a dispenser that is carried on the body and releases individual shells in seriatim fashion. My attention has been called to the following patents: U.S. Pat. Nos. 4,685,600, 4,657,132, 4,583,659, 4,381,845 and 710,324. For the most part, such devices are unsatisfactory because the shells must be grasped by the fingers once dispensed and then guided into the barrel of the gun. Moreover, the dispensing operation must be repeated if both barrels of a double barrel shotgun are to be reloaded.

A device for loading cartridges directly into a cartridge chamber of a revolver is disclosed in U.S. Pat No. 2,592,415 and includes a plurality of spring clips which grasp the sides of the cartridge. However, the device illustrated in U.S. Pat. No. 2,592,415 is grasped by the fingers during loading of the cartridges and should be held in an upright orientation since the clip engages the cartridge along a substantial portion of its length and thus the cartridges should preferably be near a vertical orientation during loading in order to smoothly drop into the chamber therebelow if hand manipulation of each cartridge is to be avoided. Furthermore, the loading device described in U.S. Pat. No. 2,592,415 is adapted to load only one cartridge at a time into the cylinder of the revolver.

SUMMARY OF THE INVENTION

My present invention overcomes the above-noted problems associated with conventional devices by provision of a reloader that is strapped to the back of the user's hand and which is adapted to directly load the shells into the barrel of a shotgun in rapid, efficient fashion, all without the need for grasping the shell. To this end, I provide a device having a spring clip which holds a shotgun shell in an orientation extending outwardly away from the back of the hand, and the shell is readily released from the device once the nose of the shell has been inserted into the shotgun barrel and the hand rocked to release the shell from the clip.

In preferred embodiments of my invention, the device is provided with two spaced apart recesses which each receive the base end of one of two shotgun shells. The recesses are spaced apart a distance complemental to the distance between barrels of a double barrel shotgun, so that both of the barrels are reloaded simultaneously as soon as the nose of the shells is inserted within respective barrels. Optionally, a single spring clip is provided to releasably secure both shells to a support of the device although other configurations are of course possible.

Advantageously, the shells are carried by the support in side-by-side fashion along the length of a strap which secures the support to the hand. In this manner, the shells are oriented in disposition for efficient loading of either side-by-side or over-and-under shotguns. Alternatively, the device may be constructed such that the shells are arranged along a line extending transversely of the strap as may be desired by particular individuals.

I have found that the device is extremely effective in cold weather when mittens or gloves are worn, since manual manipulation of the shells during the reloading operation is rendered unnecessary. Each end of the strap is provided with hook and pile fastening structure so that the effective length of the strap may be varied as desired.

BRIEF DESCRIPTION OF THE DRAWINGS

FIG. 1 is a side elevational view of a shotgun reloading device constructed in accordance with the principles of my present invention, illustrating the device in use during a reloading operation;

FIG. 2 is an enlarged, perspective view of the device shown in FIG. 1, depicting the parallel, outwardly extending orientation of a pair of shells which are releasably carried by the device;

FIG. 3 is an enlarged, side elevational view of the device shown in FIGS. 1–2;

FIG. 4 is a fragmentary, end cross-sectional view of the device taken along line 4—4 of FIG. 3;

FIG. 5 is a fragmentary, plan view of the device shown in FIG. 3 with a portion of a top panel of the device cut away to reveal an internal spring clip for releasably securing the shells to the device; and FIG. 6 is a reduced, perspective, exploded view of the device shown in FIGS. 1–5 with the shells and a strap removed.

DETAILED DESCRIPTION OF THE DRAWINGS

A shotgun reloading device constructed in accordance with the invention is shown in FIGS. 1–6 and is designated by the numeral 10. In broad terms, the device 10 includes a support 12 which carries a spring clip 14, and an elongated strap 16 is connected to the support 12 for securing the latter to a portion of an upper limb of a human body such as the back of a user's hand 18 as illustrated in FIGS. 1 and 2.

As can be best observed by reference to FIGS. 3–6, the support 12 is comprised of a generally flat body 20 along with an overlying, flat panel 22 that is secured by an adhesive or other means to the top of body 20. The body 20 has a central, flat wall segment 24 which is spaced below overlying regions of the panel 22, and also includes a somewhat U-shaped channel 26 (FIG. 6)

communicating with the space between the segment 24 and panel 22. The spring clip 14, being of a generally U-shaped configuration, includes a bight region that is received in the channel 26, while opposed legs of the spring clip 14 extend into the aforementioned space between panel 22 and the flat segment 24 therebelow.

By comparison of FIGS. 5 and 6, it can be observed that the panel 22 is formed to present a pair of substantially curved, somewhat J-shaped edge flanges 28 which, in combination with the flat segment 24, define a pair of recess sections 30 (FIG. 6). The radius of curvature of each flange 28 is slightly larger than the radius of curvature of a base portion 32 of a shotgun shell 34 as can be understood by viewing, for example, FIG. 5.

When the shells 34 are loaded onto device 10, a flat end 36 (FIG. 3) of the base portion 32 of each shell 34 comes into flat, firm engagement with the flat wall segment 24 of the body 20. At the same time, a curved end segment 38 of the clip 14 engages the circular periphery of a flange or rim 40 formed on the end of a base portion 32 of shell 34. Additionally, a portion of each curved flange 28 contacts the base portion 32 directly above the rim 40 at a location generally opposite from the point of contact of the curved segment 38 with the rim 40, as is shown in FIG. 5.

Finally, the body 20 is integrally formed to present a pair of spaced apart, depending sections having rectangular apertures 42 which receive the strap 16 for connecting the strap 16 to the support 12. Each end of the strap 16 carries a section of hook and pile fastening structure 44, 46 such as that sold under the trademark Velcro. As such, the effective length of the strap 16 may be easily varied to accommodate dimensions of the wearer's hand as well as to fit over gloves or mittens.

Preferably, the recess sections 30 are spaced apart from each other a distance corresponding to the lateral spacing between a pair of barrels 48 of a shotgun 50 that is illustrated in FIG. 1. In particular, the recess sections 30 are arranged such that the transverse distance between the longitudinal axes of the shells 34 when coupled to the support 12 are spaced apart from each other a distance equal to the distance between the central axes of the shotgun barrels 48. Consequently, front end portions 52 of both shells 34 may be simultaneously guided into the barrels 48 as the back of the hand is moved toward the shotgun 50 in the manner shown in FIG. 1 in order to load both barrels 48 at the same time. The wall segment 24, being in flat contact with the ends 36 of shells 34, facilitates insertion of the shells 34 by preventing unintentional, longitudinal movement of the latter relative to support 12.

Once the shells 34 have been inserted into the barrels 48 a distance sufficient for the panel 22 of the support 12 to either come in contact with the shotgun 50 or alternatively be located closely spaced to the latter, the shells 34 may be released from the support 12 by rocking the device 10 in a manner to cause the clip 14 to disengage both rims 40. Specifically, the shells 34 may be released from the device 10 by slightly tilting the hand 18 in such a manner that the flat wall segment 24 is tilted relative to a reference plane that is perpendicular to the central axes of the shotgun barrels 48, at which time portions of the rims 40 of the shells 34 are moved away from the flat wall segment 24 to thereby cause the curved segments 38 to disengage rims 40 and release the shells 34 from support 12 while the front end portions 52 remain captured within barrels 48.

The device 10 can be quickly reloaded by shifting the shell 34 in a lateral direction such that the flat end 36 of the shell 34 slides along the wall segment 24 until rim 40 moves beneath the flange 28 and the flange 28 comes into contact with sides of the base portion 32. During such movement, each rim 40 contacts the corresponding curved segment 38 of the spring 14 to cause the latter to deflect outwardly in a lateral direction sufficient to provide clearance between the curved segment 38 and opposed portions of the flange 28. Thereafter, the inherent bias of the spring 14 urges the curved segment 38 towards the center of the support 12 whereby the shell 34 is releasably secured in place on the support 12 between the curved segment 38 and opposed portions of the flange 28.

While the foregoing sets forth a detailed description of a currently preferred embodiment of my invention, various modifications and additions to my invention can of course be effected without departing from the gist and essence of my contribution to the art. As an example, the strap 16 may be connected to the support 12 in a perpendicular orientation to that shown in the drawings such that the shells 34 are disposed along a line extending transverse of the longitudinal axis of the strap 16. Other variations may also readily come to mind to those individuals skilled in the art. Accordingly, it is to be understood that the invention should be deemed limited only by a fair scope of the claims which follow.

What I claim is:

1. For use with an enlongated shotgun shell having a base portion and a casing with a front end portion remote from said base portion, a shotgun reloading device comprising:

a support having a generally flat wall segment extending generally along a reference plane;

means connected to said support for releasably securing said support to a portion of an upper limb of a human body in disposition such that said reference plane extends in generally parallel relation to said portion of the upper limb;

means for releasably coupling said base portion of said shell to said support in an orientation extending outwardly from said support such that the front end portion of the shell is spaced from the support and the longitudinal axis of the shell is generally perpendicular to said reference plane;

wherein said base portion of said shell includes a generally circular, outwardly extending rim, and wherein said means for releasably coupling said base portion of said shell with said support includes a resilient clip engageable with said rim when said base portion of said shell is coupled with said support; and wherein said support includes structure defining a recess section for said base portion of said shell, and a stationary flange adapted for contact with said base portion of said shell at a location remote from the position of engagement of said clip with said rim.

2. The invention as set forth in claim 1, wherein said shotgun shell presents a generally flat end, and wherein said generally flat wall segment is in direct, abutting contact with said end of said shell when said shell is coupled to said support.

3. The invention as set forth in claim 1, wherein said flange extends in a curve complemental in configuration to the configuration of said rim of said shell.

4. The invention as set forth in claim 1, wherein said means releasably coupling said base portion of said shell with said support includes means for releasing said shell when the support is rocked to cause the longitudinal axis of said shell to shift relative to said reference plane.

5. The invention as set forth in claim 1, wherein said means for releasably supporting said shell in an outwardly extending direction includes means for releasably supporting two shells in parallel, outwardly extending directions in generally side-by-side relationship relative to each other.

6. The invention as set forth in claim 1, wherein said means for releasably securing said support to a portion of a human's upper limb includes a pair of strap sections each secured to said support and having releasable fasteners.

* * * * *